US010790624B2

(12) United States Patent
Wang et al.

(10) Patent No.: US 10,790,624 B2
(45) Date of Patent: Sep. 29, 2020

(54) COAXIAL CONNECTOR

(71) Applicant: Tyco Electronics (Shanghai) Co. Ltd., Shanghai (CN)

(72) Inventors: Yunhe Wang, Shanghai (CN); Zhigang Song, Shanghai (CN); Jiahui Chen, Shanghai (CN); Lin Ni, Shanghai (CN); Songhua Liu, Dongguan (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/365,806

(22) Filed: Mar. 27, 2019

(65) Prior Publication Data

US 2019/0305495 A1 Oct. 3, 2019

(30) Foreign Application Priority Data

Mar. 30, 2018 (CN) ..... 2018 1 0291330

(51) Int. Cl.

| | |
|---|---|
| ***H01R 24/50*** | (2011.01) |
| ***H01R 12/71*** | (2011.01) |
| ***H01R 13/24*** | (2006.01) |
| ***H01R 12/73*** | (2011.01) |
| ***H01R 12/91*** | (2011.01) |
| ***H01R 12/70*** | (2011.01) |
| *H01R 103/00* | (2006.01) |

(52) U.S. Cl.

CPC ..... *H01R 24/50* (2013.01); *H01R 12/714* (2013.01); *H01R 12/73* (2013.01); *H01R 12/91* (2013.01); *H01R 13/2407* (2013.01); *H01R 12/707* (2013.01); *H01R 12/7011* (2013.01); *H01R 2103/00* (2013.01)

(58) Field of Classification Search

CPC ..... H01R 13/2421; H01R 24/50; H01R 2103/00; H01R 13/6315; H01R 12/714; H01R 12/716; H01R 24/40; H01R 12/7082; H01R 13/2407; H01R 24/52; H01R 12/71; H01R 12/91; H01R 13/17; H01R 13/24; H01R 2201/02

See application file for complete search history.

(56) References Cited

U.S. PATENT DOCUMENTS

| | | | | |
|---|---|---|---|---|
| 5,516,303 | A * | 5/1996 | Yohn | H01R 13/6315 439/248 |
| 6,758,680 | B2 | 7/2004 | Duquerroy et al. | |
| 6,776,668 | B1 | 8/2004 | Van Scyoc et al. | |

(Continued)

*Primary Examiner* — Edwin A. Leon
*Assistant Examiner* — Matthew T Dzierzynski
(74) *Attorney, Agent, or Firm* — Barley Snyder

(57) ABSTRACT

A connector comprises a plurality of outer contacts including a first outer contact and a second outer contact that are slidably assembled together, a plurality of inner contacts disposed within the outer contacts, and a first elastic element disposed between the first outer contact and the second outer contact and adapted to exert a first axial pushing force onto the first outer contact. The second outer contact has an outer cylinder and an inner cylinder connected to the outer cylinder. A receiving groove having an annular cross section is defined between the outer cylinder and the inner cylinder. The first outer contact has an elastic latch adapted to be inserted into the receiving groove and adapted to be latched onto an inner wall of the outer cylinder.

21 Claims, 6 Drawing Sheets

(56) References Cited

U.S. PATENT DOCUMENTS

| | | | | |
|---|---|---|---|---|
| 7,416,418 | B2 * | 8/2008 | Berthet | H01R 24/50 439/63 |
| 7,422,456 | B1 * | 9/2008 | Mitani | H01R 13/6315 439/247 |
| 7,922,529 | B1 * | 4/2011 | Meurer | H01R 24/50 439/248 |
| 7,972,173 | B1 * | 7/2011 | Hyzin | H01R 13/2421 439/578 |
| 9,130,328 | B1 * | 9/2015 | Huang | H01R 13/2421 |
| 9,147,955 | B2 * | 9/2015 | Hanson | H01R 13/2421 |
| 9,590,345 | B2 * | 3/2017 | Wollitzer | H01R 13/2421 |
| 10,069,257 | B1 * | 9/2018 | Soubh | H01R 24/40 |
| 10,249,968 | B2 * | 4/2019 | Dandl | H01R 12/716 |
| 2002/0081910 | A1 * | 6/2002 | Kihira | H01R 12/7082 439/700 |

* cited by examiner

COAXIAL CONNECTOR

CROSS-REFERENCE TO RELATED APPLICATION

This application claims the benefit of the filing date under 35 U.S.C. § 119(a)-(d) of Chinese Patent Application No. 201810291330.9, filed on Mar. 30, 2018.

FIELD OF THE INVENTION

The present invention relates to a connector and, more particularly, to a radio frequency (RF) coaxial connector.

BACKGROUND

A radio frequency (RF) coaxial connector of a printed circuit board to printed circuit board (BTB) type has a lower end soldered to a lower printed circuit board (PCB) and an upper end in electrical contact with an upper PCB. An upper outer contact of the RF coaxial connector is a contact ring which is pressed by an external spring to ensure an electrical contact with the upper PCB. A lower outer contact of the RF coaxial connector is a housing which is soldered to the lower PCB so as to ensure an electrical connection with the lower PCB. The contact ring is latched onto the housing by an elastic latch. A lower half of an inner contact of the RF coaxial connector is soldered to the lower PCB to ensure an electrical connection with the lower PCB. An upper half of the inner contact is pressed by an internal spring to ensure an electrical contact with the upper PCB. The relative position between the inner contact and the housing is ensured by an insulator.

Because the contact ring is latched onto an outer wall of the housing by the elastic latch, the elastic latch will expand outward when a large axial pushing force is applied to the contact ring. The elastic latch may be easily disengaged from the housing, causing a disengagement of the contact ring from the housing. Further, the external spring pressing the contact ring is usually exposed outside the connector and lacks suitable protection.

SUMMARY

A connector comprises a plurality of outer contacts including a first outer contact and a second outer contact that are slidably assembled together, a plurality of inner contacts disposed within the outer contacts, and a first elastic element disposed between the first outer contact and the second outer contact and adapted to exert a first axial pushing force onto the first outer contact. The second outer contact has an outer cylinder and an inner cylinder connected to the outer cylinder. A receiving groove having an annular cross section is defined between the outer cylinder and the inner cylinder. The first outer contact has an elastic latch adapted to be inserted into the receiving groove and adapted to be latched onto an inner wall of the outer cylinder.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
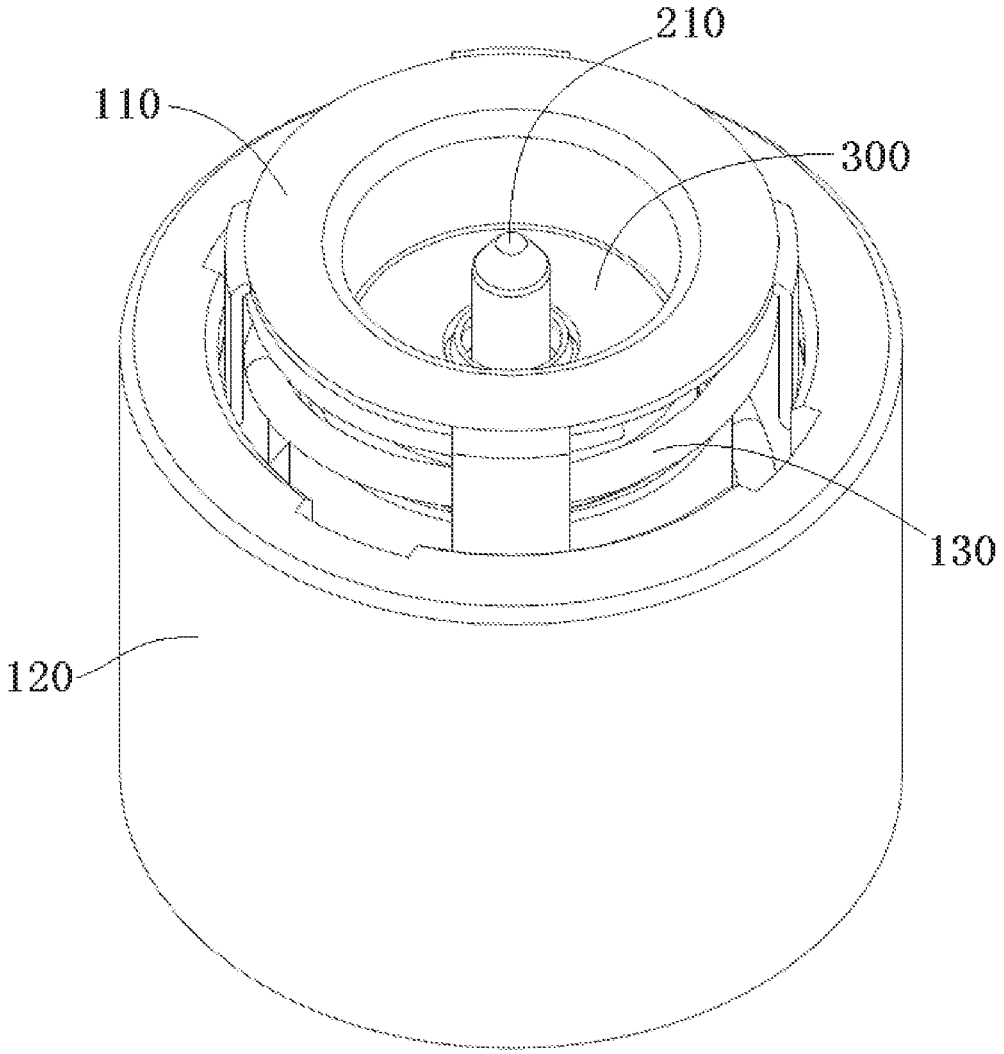
FIG. 1 is a perspective view of a connector according to an embodiment.

Technical solutions will be further specifically described below with reference to the embodiments of the present disclosure, taken in conjunction with the accompanying drawings. In the specification, the same or similar reference numerals indicate the same or similar elements. The description of the embodiments of the present disclosure with reference to the accompanying drawings is intended to illustrate the general inventive concept of the present disclosure, and should not be construed as limiting the invention.

Moreover, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A connector according to an embodiment, as shown in FIGS. 1-4, is used to electrically connect a first electronic component 1 with a second electronic component 2. The connector comprises a plurality of outer contacts 110, 120, a plurality of inner contacts 210, 220, and a first elastic element 130. In an embodiment, the connector is a radio frequency (RF) coaxial connector. In the embodiment shown in FIG. 2, the first electronic component 1 and the second electronic component 2 are both circuit boards, however, in another embodiment, the second electronic component 2 may be a filter.

The outer contacts 110, 120, as shown in FIGS. 1-4, include a first outer contact 110 and a second outer contact 120 which are slidably assembled together. The inner contacts 210, 220 are disposed within the outer contacts 110, 120; the inner contacts 210, 220 are provided in a longitudinal passageway extending through the outer contacts 110, 120. The inner contacts 210, 220 include a first inner contact 210 and a second inner contact 220 which are slidably assembled together.

Figure 2:
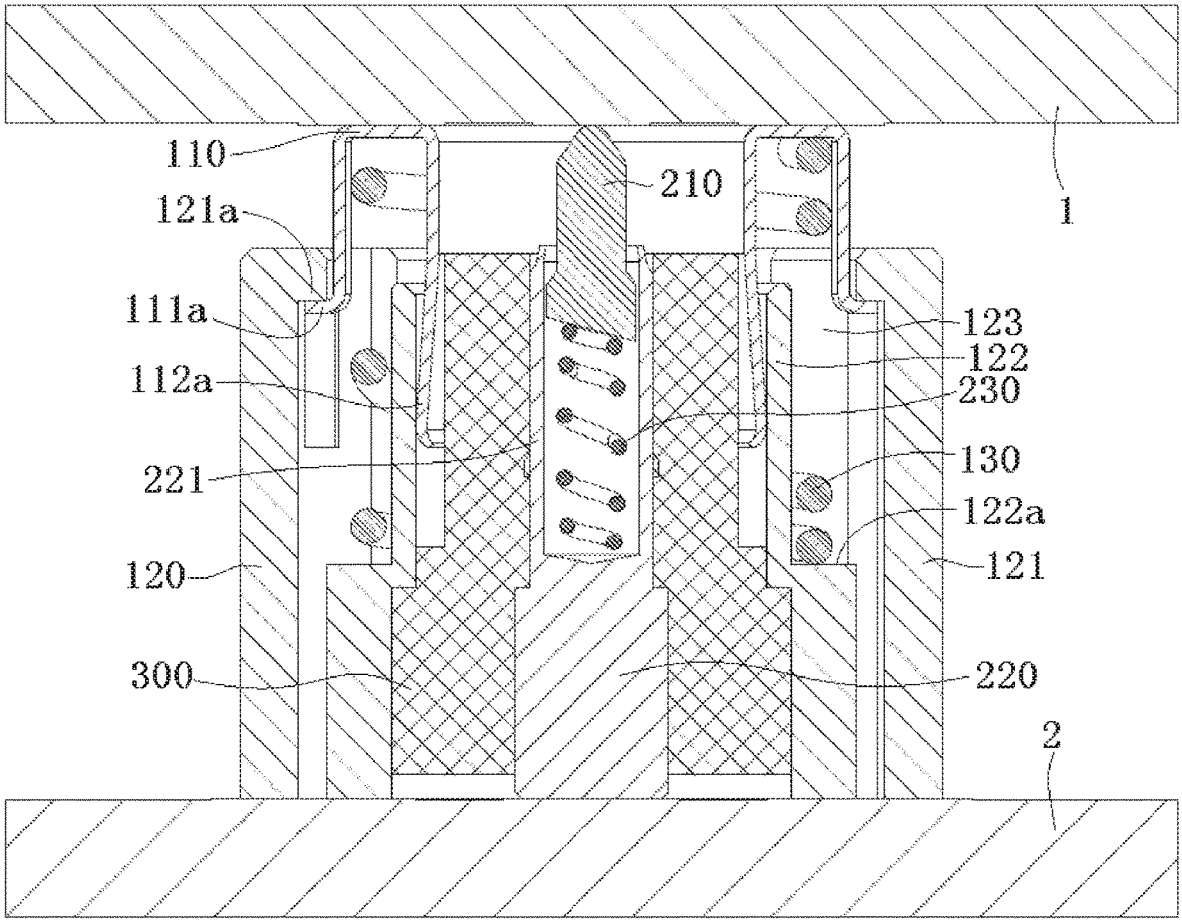
FIG. 2 is a sectional side view of the connector of FIG. 1.

The first elastic element 130, as shown in FIGS. 1 and 2, is disposed between the first outer contact 110 and the second outer contact 120 and is adapted to exert a first axial pushing force onto the first outer contact 110. The first outer contact 110 is in a reliable electrical contact with the first electronic component 1 under the axial pushing force exerted by the first elastic element 130.

Figure 3:
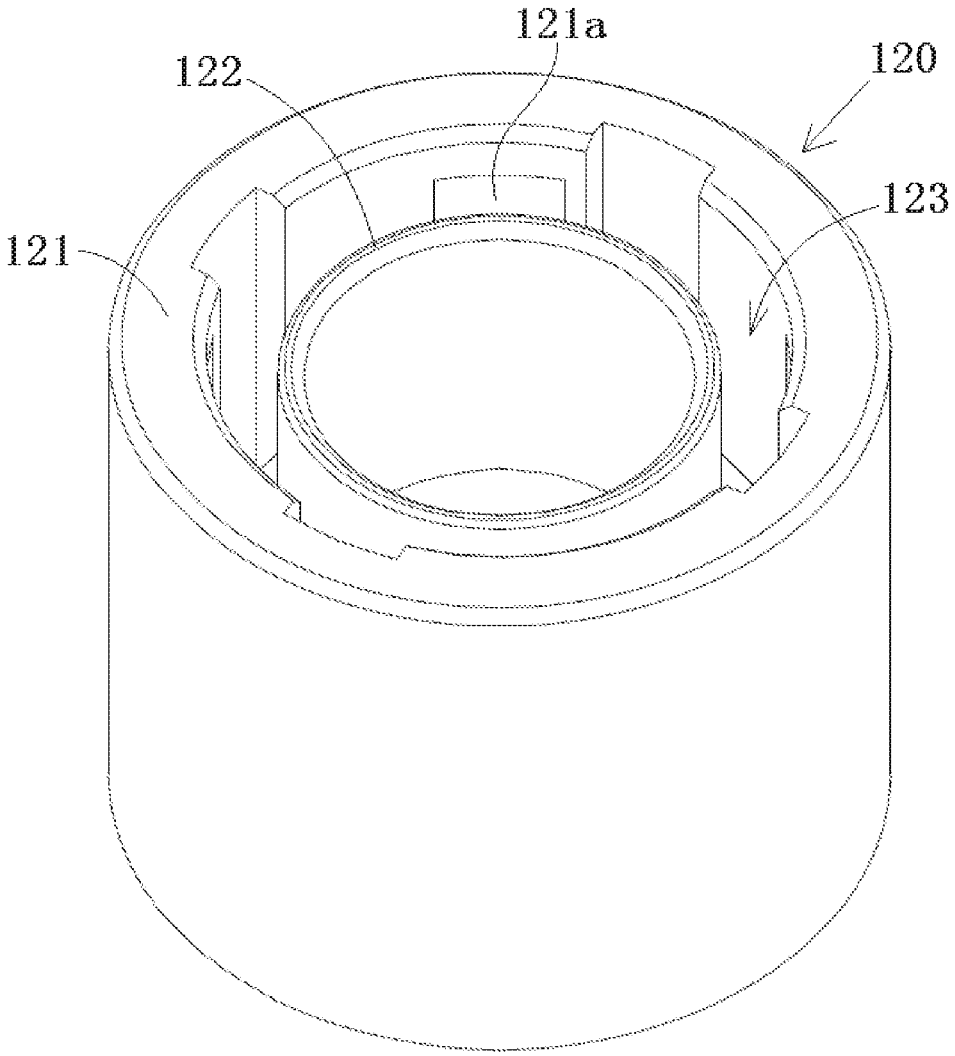
FIG. 3 is a perspective view of a second outer contact of the connector of FIG. 1.

The second outer contact 120, shown in FIGS. 1-3, includes an outer cylinder 121 and an inner cylinder 122 connected to the outer cylinder 121. A receiving groove 123 having an annular cross section is defined between the outer cylinder 121 and the inner cylinder 122. In an embodiment, the second outer contact 120 is integrally formed of metal by a casting process.

Figure 4:
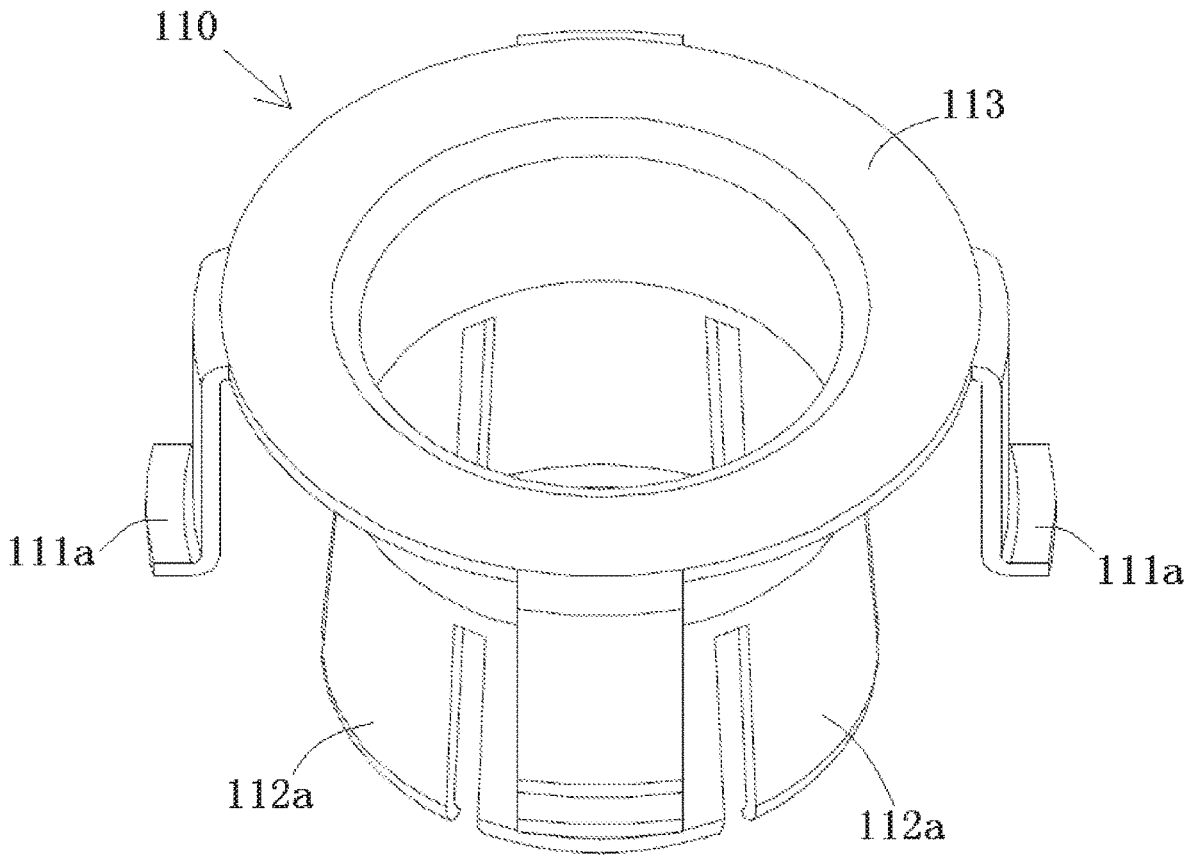
FIG. 4 is a perspective view of a first outer contact of the connector of FIG. 1.

The first outer contact 110, as shown in FIGS. 1, 2, and 4, includes an elastic latch 111*a* and an elastic arm 112*a*. The elastic latch 111*a* is inserted into the receiving groove 123 and is adapted to be latched onto an inner wall of the outer cylinder 121. The elastic arm 112*a* is inserted into the inner cylinder 122 and is adapted to be in an elastically electrical contact with an inner wall of the inner cylinder 122. In an embodiment, the first outer contact 110 is a single conductive element formed by stamping a single metal sheet.

As shown in FIGS. 2 and 3, a blocking protrusion 121*a* is formed on the inner wall of the outer cylinder 121. The elastic latch 111*a* is adapted to be latched onto the blocking protrusion 121*a* to prevent the first outer contact 110 from moving outwardly relative to the second outer contact 120, preventing the first outer contact 110 from disengaging from the second outer contact 120. In the shown embodiment, the elastic latch 111*a* is an L-shaped elastic hook adapted to hook the blocking protrusion 121*a*.

The first elastic element 130, as shown in FIGS. 1 and 2, is received in the receiving groove 123, a first end of the first elastic element 130 abuts against the first outer contact 110 and a second end of the first elastic element 130 abuts against the second outer contact 120.

The first outer contact 110 has a base 113, shown in FIG. 4, to which the elastic latch 111*a* and the elastic arm 112*a* are coupled. The first end of the first elastic element 130 abuts against the base 113. The base 113 has an annular plate shape. The elastic latch 111*a* is coupled to an outer edge of the base 113 and the elastic arm 112*a* is coupled to an inner edge of the base 113. In the shown embodiment, the first outer contact 110 includes a plurality of elastic latches 111*a*. The plurality of elastic latches 111*a* are evenly distributed around an outer circumference of the base 113. In the shown embodiment, the first outer contact 110 includes a plurality of elastic arms 112*a*. The plurality of elastic arms 112*a* are evenly distributed around an inner circumference of the base 113.

As shown in FIGS. 1-3, a raised positioning step 122*a* is formed on an outer wall of the inner cylinder 122, and the second end of the first elastic element 130 abuts against the positioning step 122*a*.

The connector, as shown in FIGS. 1 and 2, comprises an insulator 300 disposed between the outer contacts 110, 120 and the inner contacts 210, 220. The insulator 300 is configured to hold the inner contacts 210, 220 within the outer contacts 110, 120 and to electrically isolate the inner contacts 210, 220 from the outer contacts 110, 120. The insulator 300 is housed in the inner cylinder 122 of the second outer contact 120, and the second inner contact 220 is held within the insulator 300.

The connector, as shown in FIG. 2, comprises a second elastic element 230 disposed between the first inner contact 210 and the second inner contact 220. The second elastic element 230 is adapted to exert a second axial pushing force onto the first inner contact 210. The first inner contact 210 is in a reliable electrical contact with the first electronic component 1 under the second axial pushing force exerted by the second elastic element 230. The second inner contact 220 has a cylindrical portion 221. An end of the first inner contact 210 is slidably inserted into the cylindrical portion 221 of the second inner contact 220, and is in a slidable electrical contact with the second inner contact 220. The inner contacts 210, 220 form a spring-like probe structure such as a pogo pin, and the second elastic element 230 is compressed by the first inner contact 210 in the cylindrical portion 221 of the second inner contact 220.

As shown in FIG. 2, the second outer contact 120 and the second inner contact 220 each have a flat bottom face adapted to be soldered onto the second electronic component 2. In other embodiments, the second outer contact 120 or the second inner contact 220 may be otherwise connected to the second electronic component 2, for example, the second outer contact 120 or the second inner contact 220 may be inserted into or screwed onto the second electronic component 2.

Figure 5:
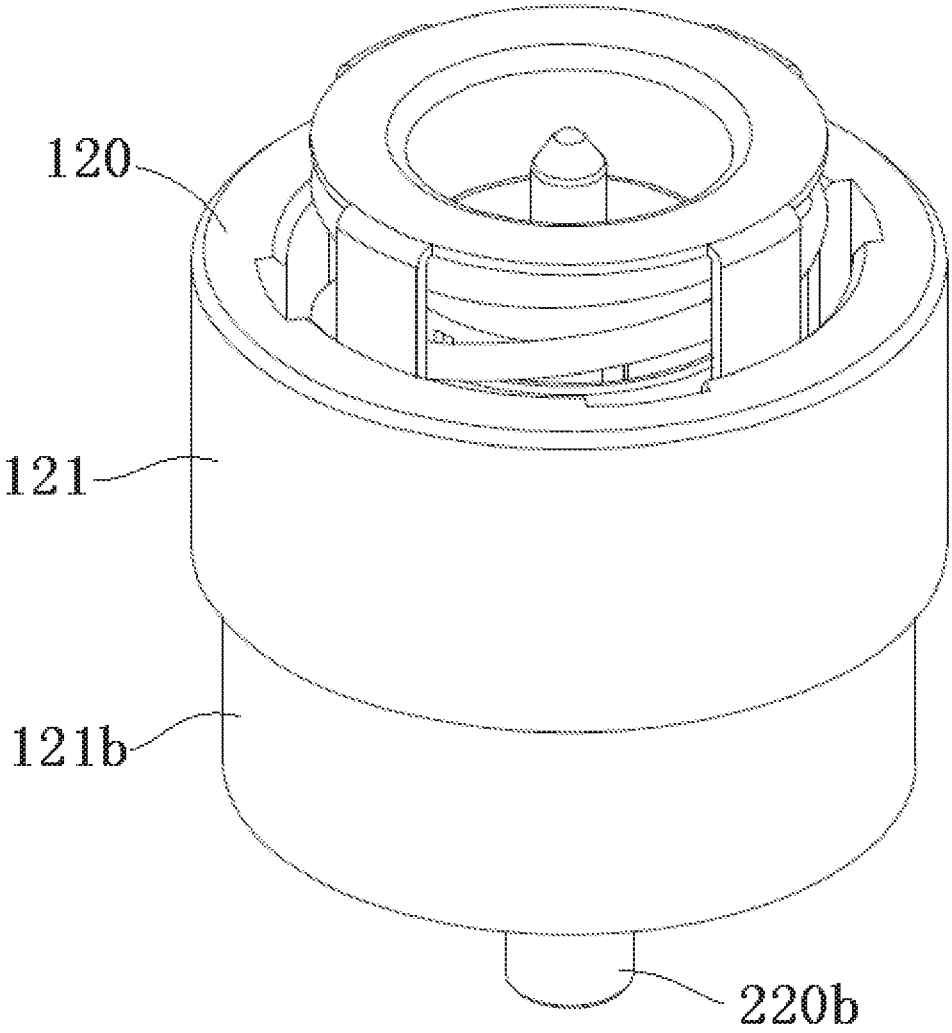
FIG. 5 is a perspective view of a connector according to another embodiment.
Figure 6:
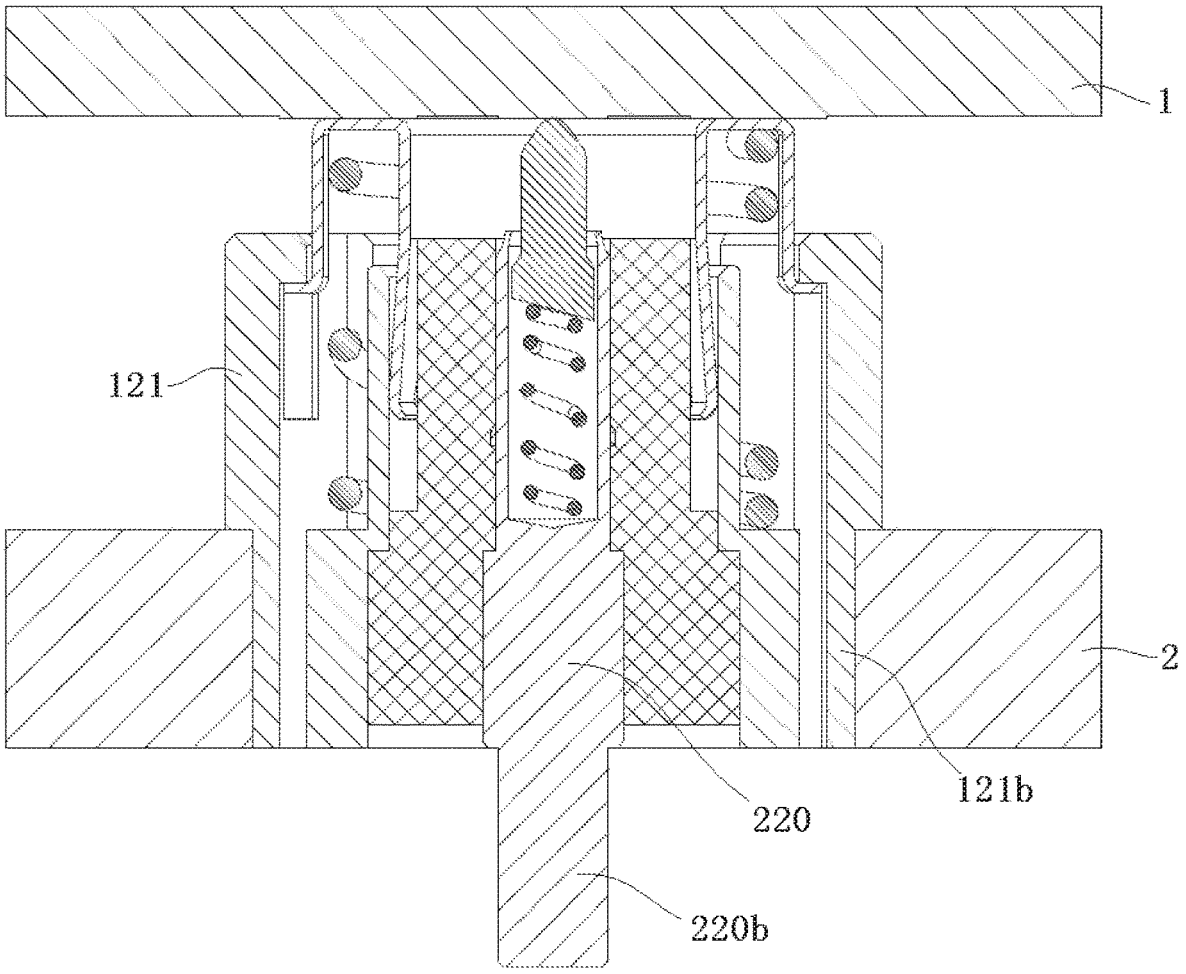
FIG. 6 is a sectional side view of the connector of FIG. 5.

A connector according to another embodiment is shown in FIGS. 5 and 6. The connector in the embodiment of FIGS. 5 and 6 differs from the embodiment shown in FIGS. 1-4 mainly in the structure of the second inner contact 220 and the outer cylinder 121 of the second outer contact 120.

In the embodiment shown in FIGS. 5 and 6, an outer diameter of a lower end portion 121*b* of the outer cylinder 121 of the second outer contact 120 is smaller than an outer diameter of an upper end portion of the outer cylinder 121. The lower end portion 121*b* of the outer cylinder 121 is adapted to be directly inserted into a socket on the second electronic component 2. The second inner contact 220 has a plug portion 220*b* that projects outwardly from the second outer contact 120, and the plug portion 220*b* may be plugged into the socket on the second electronic component 2.

In other embodiments, a threaded portion may be formed on an outer wall of the outer cylinder 121 of the second outer contact 120. The second outer contact 120 may be screwed onto the second electronic component 2 by the threaded portion.

What is claimed is:

1. A connector, comprising:

a plurality of outer contacts including a first outer contact and a second outer contact that are slidably assembled together, the second outer contact has an outer cylinder and an inner cylinder arranged within and connected to the outer cylinder, a receiving groove having an annular cross section is defined between the outer cylinder and the inner cylinder, the first outer contact having:

an elastic latch received within the receiving groove and adapted to be latched onto an inner wall of the outer cylinder;

an elastic arm engaging with the inner cylinder; and a base, wherein the elastic latch is connected to an outer edge of the base and the elastic arm is connected to an inner edge of the base;

a plurality of inner contacts disposed within the outer contacts; and a first elastic element disposed between the first outer contact and the second outer contact and adapted to exert a first axial pushing force onto the first outer contact.

2. The connector of claim 1, wherein the inner contacts include a first inner contact and a second inner contact that are slidably assembled together.

3. The connector of claim 2, further comprising an insulator disposed between the outer contacts and the inner contacts, the insulator configured to hold the inner contacts within the outer contacts and electrically isolate the inner contacts from the outer contacts.

4. The connector of claim 3, wherein the insulator is housed in the inner cylinder of the second outer contact, and the second inner contact is held within the insulator.

5. The connector of claim 2, further comprising a second elastic element disposed between the first inner contact and the second inner contact and adapted to exert a second axial pushing force onto the first inner contact, the first inner contact is in a reliable electrical contact with a first electronic component under the second axial pushing force.

6. The connector of claim 5, wherein the second inner contact has a cylindrical portion, an end of the first inner contact is slidably inserted into the cylindrical portion of the second inner contact and the first inner contact is in a slidable electrical contact with the second inner contact.

7. The connector of claim 6, wherein the inner contacts form a spring-like probe structure, the second elastic element is compressed by the first inner contact in the cylindrical portion of the second inner contact.

8. The connector of claim 2, wherein the second outer contact or the second inner contact is adapted to be soldered onto, inserted into, or screwed onto a second electronic component.

9. The connector of claim 8, wherein the second outer contact and the second inner contact each have a flat bottom face adapted to be soldered onto the second electronic component, or a threaded portion is formed on an outer wall of the outer cylinder of the second outer contact and the second outer contact is adapted to be screwed onto the second electronic component by the threaded portion.

10. The connector of claim 1, wherein the first outer contact is a single conductive element formed by stamping a single metal sheet and the second outer contact is integrally cast from a metallic material.

11. The connector of claim 1, wherein the inner wall of the outer cylinder has a blocking protrusion, the elastic latch is adapted to be latched onto the blocking protrusion to prevent the first outer contact from moving outwardly relative to the second outer contact and preventing the first outer contact from disengaging from the second outer contact.

12. The connector of claim 11, wherein the elastic latch is an L-shaped elastic hook adapted to hook the blocking protrusion.

13. The connector of claim 1, wherein a first end of the first elastic element abuts the first outer contact and a second end of the first elastic element abuts the second outer contact.

14. The connector of claim 13, wherein a raised positioning step is formed on an outer wall of the inner cylinder, the second end of the first elastic element abuts against the raised positioning step.

15. The connector of claim 1, wherein the connector is a radio frequency coaxial connector adapted to be electrically connected between a first electronic component and a second electronic component, the first electronic component is a circuit board and the second electronic component is a circuit board or a filter.

16. A connector, comprising:

a plurality of outer contacts including a first outer contact and a second outer contact that are slidably assembled together, the second outer contact has an outer cylinder and an inner cylinder connected to the outer cylinder, a receiving groove having an annular cross section is defined between the outer cylinder and the inner cylinder, the first outer contact having:

an elastic latch adapted to be inserted into the receiving groove and adapted to be latched onto an inner wall of the outer cylinder; and an elastic arm adapted to be inserted into the inner cylinder and in an elastically electrical contact with the inner cylinder;

a plurality of inner contacts disposed within the outer contacts; and a first elastic element disposed between the first outer contact and the second outer contact and adapted to exert a first axial pushing force onto the first outer contact.

17. The connector of claim 16, wherein the first outer contact has a base to which the elastic latch and the elastic arm are coupled, the first end of the first elastic element abuts the base.

18. The connector of claim 17, wherein the base of the first outer contact has an annular plate shape, the elastic latch is connected to an outer edge of the base and the elastic arm is connected to an inner edge of the base.

19. The connector of claim 18, wherein the first outer contact has a plurality of elastic latches evenly distributed around an outer circumference of the base.

20. The connector of claim 18, wherein the first outer contact has a plurality of elastic arms evenly distributed around an inner circumference of the base.

21. A connector, comprising:

a first outer contact including:

an elastic latch; and an elastic arm;

a second outer contact moveably connected to the first outer contact, the second outer contact including an outer housing member and an inner housing member arranged within the outer housing member, and an opening defined between the outer housing member and the inner member, receiving the elastic latch for moveably connecting the first outer contact to the second outer contact, the elastic arm inserted into and in electrical contact with the inner cylinder;

an inner contact disposed within the first and second outer contacts; and a first elastic element disposed between the first outer contact and the second outer contact and adapted to exert an axial force onto the first outer contact.

* * * * *